US009274465B2

(12) United States Patent
Samei et al.

(10) Patent No.: US 9,274,465 B2
(45) Date of Patent: Mar. 1, 2016

(54) IMAGE FORMING APPARATUS WITH A HEATER CONTROLLER AND IMAGE FORMING METHOD TO CONTROL HEATING

(71) Applicants: Masahiro Samei, Osaka (JP); Tomoya Adachi, Osaka (JP); Daisuke Inoue, Osaka (JP); Yasuharu Kawarasaki, Hyogo (JP); Yoshiharu Takahashi, Osaka (JP)

(72) Inventors: Masahiro Samei, Osaka (JP); Tomoya Adachi, Osaka (JP); Daisuke Inoue, Osaka (JP); Yasuharu Kawarasaki, Hyogo (JP); Yoshiharu Takahashi, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/602,766

(22) Filed: Jan. 22, 2015

(65) Prior Publication Data

US 2015/0220028 A1 Aug. 6, 2015

(30) Foreign Application Priority Data

Feb. 3, 2014 (JP) ..... 2014-018438

(51) Int. Cl.
*G03G 15/20* (2006.01)

(52) U.S. Cl.
CPC .... *G03G 15/2039* (2013.01); *G03G 2215/2035* (2013.01)

(58) Field of Classification Search
CPC ..... G03G 15/2039; G03G 15/2046; G03G 15/2078
USPC ..... 399/69, 45, 328, 329
See application file for complete search history.

(56) References Cited

U.S. PATENT DOCUMENTS

| | | | | |
|---|---|---|---|---|
| 2008/0131160 | A1* | 6/2008 | Mitsuoka et al. | 399/70 |
| 2011/0058865 | A1* | 3/2011 | Tokuda et al. | 399/329 |
| 2011/0222927 | A1* | 9/2011 | Yamashina | 399/328 |
| 2011/0299899 | A1 | 12/2011 | Ishigaya et al. | |
| 2012/0093532 | A1 | 4/2012 | Ishigaya et al. | |
| 2012/0093534 | A1 | 4/2012 | Waida et al. | |
| 2012/0148287 | A1 | 6/2012 | Samei et al. | |
| 2012/0148317 | A1 | 6/2012 | Samei et al. | |

(Continued)

FOREIGN PATENT DOCUMENTS

| | | |
|---|---|---|
| JP | 11-282308 | 10/1999 |
| JP | 2002-116658 | 4/2002 |
| JP | 2008-058408 | 3/2008 |

(Continued)

OTHER PUBLICATIONS

U.S. Appl. No. 14/609,028, filed Jan. 29, 2015.

*Primary Examiner* — Sophia S Chen
(74) *Attorney, Agent, or Firm* — Oblon, McClelland, Maier & Neustadt, L.L.P.

(57) ABSTRACT

An image forming apparatus includes a controller including a primary heating control portion to control a heater to perform a primary heating to heat a fixing rotator with a first amount of power determined based on a temperature of the fixing rotator, a secondary heating control portion to control the heater to perform a secondary heating to heat the fixing rotator with a preset second amount of power, and a switch portion to control the heater to switch between the primary heating and the secondary heating during an identical print job and to perform at least one of a primary switching from the primary heating to the secondary heating and a secondary switching from the secondary heating to the primary heating at a time different from a preset control cycle that defines a power supply time in the primary heating and the secondary heating.

20 Claims, 11 Drawing Sheets

(56) References Cited

U.S. PATENT DOCUMENTS

| | | | |
|---|---|---|---|
| 2012/0177393 | A1 | 7/2012 | Ikebuchi et al. |
| 2012/0243895 | A1 | 9/2012 | Samei et al. |
| 2013/0051876 | A1 | 2/2013 | Ishigaya et al. |
| 2013/0202322 | A1 | 8/2013 | Waida et al. |
| 2013/0209122 | A1 | 8/2013 | Yamashina et al. |
| 2013/0209123 | A1 | 8/2013 | Waida et al. |
| 2013/0209126 | A1 | 8/2013 | Seo et al. |
| 2013/0308990 | A1 | 11/2013 | Samei et al. |
| 2014/0099138 | A1 | 4/2014 | Ishigaya et al. |
| 2014/0133877 | A1 | 5/2014 | Samei et al. |

FOREIGN PATENT DOCUMENTS

| | | |
|---|---|---|
| JP | 2009-288432 | 12/2009 |
| JP | 2012-145626 | 8/2012 |
| JP | 2013-156340 | 8/2013 |
| JP | 2013-160985 | 8/2013 |
| JP | 2013-178453 | 9/2013 |
| JP | 2013-178454 | 9/2013 |
| JP | 2013-178455 | 9/2013 |

* cited by examiner

| SHEET TYPE | POWER (W) |
|---|---|
| THIN PAPER | 450 |
| PLAIN PAPER 1 | 500 |
| PLAIN PAPER 2 | 550 |
| MEDIUM THICKNESS PAPER | 600 |
| THICK PAPER | 650 |

| TEMPERATURE DIFFERENCE (°C) | CORRECTION AMOUNT OF POWER (W) |
|---|---|
| SMALLER THAN −10 | +100 |
| NOT SMALLER THAN −10 AND SMALLER THAN −5 | +50 |
| NOT SMALLER THAN −5 AND SMALLER THAN 0 | 0 |
| NOT SMALLER THAN 0 AND SMALLER THAN 5 | 0 |
| NOT SMALLER THAN 5 AND SMALLER THAN 10 | −50 |
| NOT SMALLER THAN 10 | −100 |

IMAGE FORMING APPARATUS WITH A HEATER CONTROLLER AND IMAGE FORMING METHOD TO CONTROL HEATING

CROSS-REFERENCE TO RELATED APPLICATION

This patent application is based on and claims priority pursuant to 35 U.S.C. §119 to Japanese Patent Application No. 2014-018438, filed on Feb. 3, 2014, in the Japanese Patent Office, the entire disclosure of which is hereby incorporated by reference herein.

BACKGROUND

1. Technical Field

Exemplary aspects of the present disclosure relate to an image forming apparatus and an image forming method, and more particularly, to an image forming apparatus for forming an image on a recording medium and an image forming method performed by the image forming apparatus.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and an opposed rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the opposed rotator apply heat and pressure to the recording medium, melting and fixing the toner image on the recording medium.

SUMMARY

This specification describes below an improved image forming apparatus. In one exemplary embodiment, the image forming apparatus includes a fixing rotator rotatable in a predetermined direction of rotation and a heater disposed opposite the fixing rotator to heat the fixing rotator. An opposed rotator presses against the fixing rotator to form a fixing nip therebetween through which a recording medium bearing a toner image is conveyed. A temperature detector is disposed opposite the fixing rotator to detect a temperature of the fixing rotator. A controller is operatively connected to the temperature detector and the heater. The controller includes a primary heating control portion, a secondary heating control portion, and a switch portion. The primary heating control portion determines a first amount of power supplied to the heater based on the temperature of the fixing rotator detected by the temperature detector and controls the heater to perform a primary heating to heat the fixing rotator with the first amount of power. The secondary heating control portion controls the heater to perform a secondary heating to heat the fixing rotator with a preset second amount of power. The switch portion controls the heater to switch between the primary heating and the secondary heating during an identical print job and performs at least one of a primary switching from the primary heating to the secondary heating and a secondary switching from the secondary heating to the primary heating at a time different from a preset control cycle that defines a power supply time in the primary heating and the secondary heating.

This specification further describes an improved image forming method. In one exemplary embodiment, the image forming method includes starting a primary heating to heat a fixing rotator with a first amount of power determined based on a temperature of the fixing rotator; starting feeding a recording medium to the fixing rotator; and switching from the primary heating to a secondary heating to heat the fixing rotator with a preset second amount of power at a time different from a preset control cycle that defines a power supply time in the primary heating and the secondary heating.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
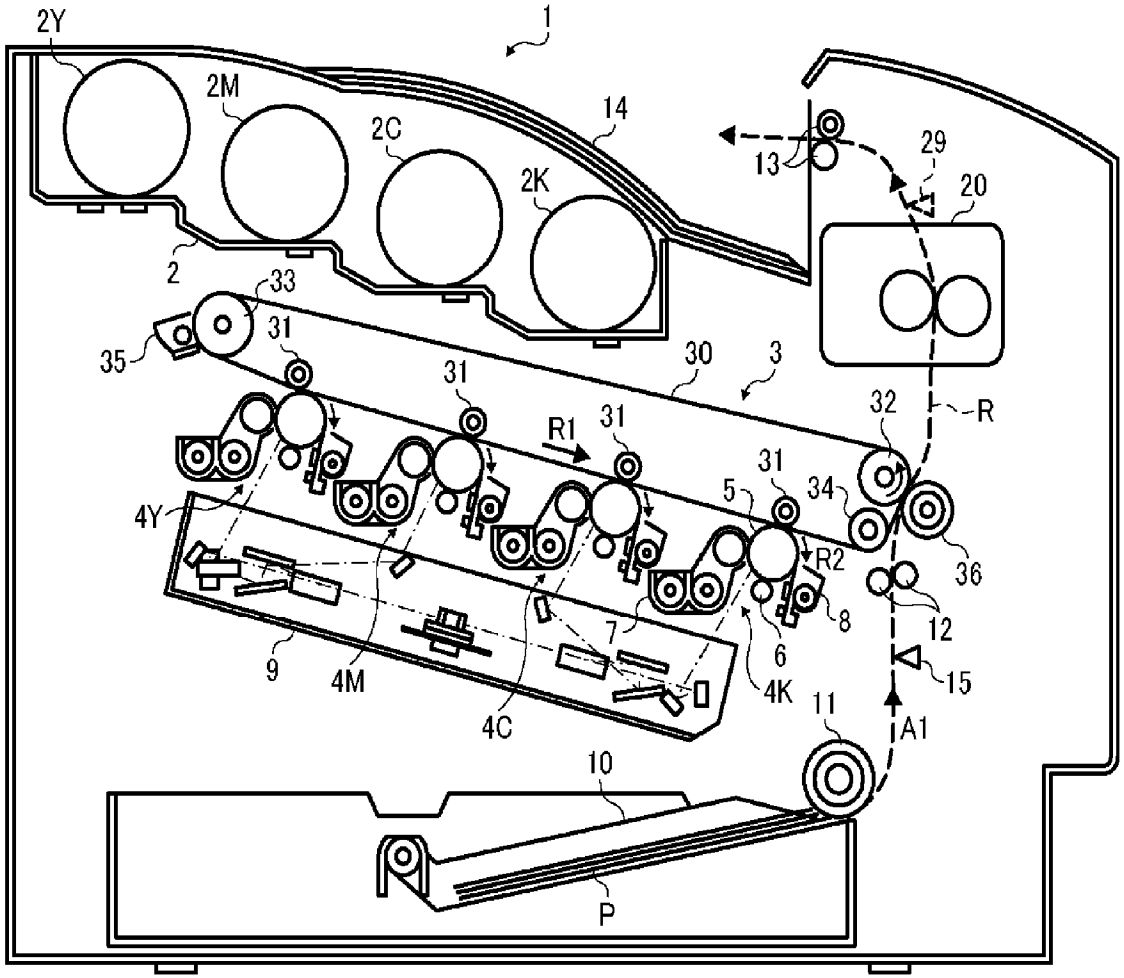
FIG. 1 is a schematic vertical sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color laser printer that forms color and monochrome toner images on recording media by electrophotography.

With reference to FIG. 1, a description is provided of a construction of the image forming apparatus 1.

As shown in FIG. 1, the image forming apparatus 1 includes four image forming devices 4Y, 4M, 4C, and 4K situated in a center portion thereof. Although the image forming devices 4Y, 4M, 4C, and 4K contain yellow, magenta, cyan, and black developers (e.g., yellow, magenta, cyan, and black toners) that form yellow, magenta, cyan, and black toner images, respectively, resulting in a color toner image, they have an identical structure.

For example, each of the image forming devices 4Y, 4M, 4C, and 4K includes a drum-shaped photoconductor 5 serving as an image bearer or a latent image bearer that bears an electrostatic latent image and a resultant toner image; a charger 6 that charges an outer circumferential surface of the photoconductor 5; a developing device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. Alternatively, the photoconductor 5 may be belt-shaped.

It is to be noted that, in FIG. 1, reference numerals are assigned to the photoconductor 5, the charger 6, the developing device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. The transfer device 3 includes an intermediate transfer belt 30, that is, an endless belt serving as a primary transferor. The intermediate transfer belt 30 is stretched taut across a secondary transfer backup roller 32, a cleaning backup roller 33, and a tension roller 34. As the secondary transfer backup roller 32 rotates counterclockwise in FIG. 1, the secondary transfer backup roller 32 rotates the intermediate transfer belt 30 counterclockwise in FIG. 1 in a rotation direction R1 by friction therebetween.

Four primary transfer rollers 31 serving as primary transferors are disposed opposite the four photoconductors 5, respectively. The four primary transfer rollers 31 are pressed against an inner circumferential surface of the intermediate transfer belt 30, forming four primary transfer nips between the four photoconductors 5 and the intermediate transfer belt 30, respectively. The primary transfer rollers 31 are connected to a power supply that applies a predetermined direct current (DC) voltage and/or alternating current (AC) voltage thereto.

A secondary transfer roller 36 is disposed opposite the secondary transfer backup roller 32 via the intermediate transfer belt 30. The secondary transfer roller 36 is pressed against an outer circumferential surface of the intermediate transfer belt 30, forming a secondary transfer nip between the secondary transfer roller 36 and the intermediate transfer belt 30. Similar to the primary transfer rollers 31, the secondary transfer roller 36 is connected to the power supply that applies a predetermined direct current voltage and/or alternating current voltage thereto.

A belt cleaner 35 is disposed opposite the cleaning backup roller 33 via the intermediate transfer belt 30.

A bottle housing 2 situated in an upper portion of the image forming apparatus 1 accommodates four toner bottles 2Y, 2M, 2C, and 2K detachably attached thereto to contain and supply fresh yellow, magenta, cyan, and black toners to the developing devices 7 of the image forming devices 4Y, 4M, 4C, and 4K, respectively. For example, the fresh yellow, magenta, cyan, and black toners are supplied from the toner bottles 2Y, 2M, 2C, and 2K to the developing devices 7 through toner supply tubes interposed between the toner bottles 2Y, 2M, 2C, and 2K and the developing devices 7, respectively.

In a lower portion of the image forming apparatus 1 are a paper tray 10 that loads a plurality of sheets P serving as recording media and a feed roller 11 that picks up and feeds a sheet P from the paper tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, overhead projector (OHP) transparencies (e.g., a sheet and film), and the like.

A conveyance path R extends from the feed roller 11 to an output roller pair 13 to convey the sheet P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a sheet conveyance direction A1. The registration roller pair 12 serving as a timing roller pair conveys the sheet P conveyed from the feed roller 11 toward the secondary transfer nip at a predetermined time.

The conveyance path R is further provided with a fixing device 20 (e.g., a fuser or a fusing unit) located above the secondary transfer nip, that is, downstream from the secondary transfer nip in the sheet conveyance direction A1. The fixing device 20 fixes a toner image transferred from the intermediate transfer belt 30 onto the sheet P conveyed from the secondary transfer nip on the sheet P. The conveyance path R is further provided with the output roller pair 13 located above the fixing device 20, that is, downstream from the fixing device 20 in the sheet conveyance direction A1. The output roller pair 13 ejects the sheet P bearing the fixed toner image onto the outside of the image forming apparatus 1, that is, an output tray 14 disposed atop the image forming apparatus 1. The output tray 14 stocks the sheet P ejected by the output roller pair 13.

With reference to FIG. 1, a description is provided of an image forming operation performed by the image forming apparatus 1 having the construction described above to form a color toner image on a sheet P.

As a print job starts, a driver drives and rotates the photoconductors 5 of the image forming devices 4Y, 4M, 4C, and 4K, respectively, clockwise in FIG. 1 in a rotation direction R2. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data constituting color image data sent from the external device, respectively, thus forming electrostatic latent images thereon. The developing devices 7 supply yellow, magenta, cyan, and black toners to the electrostatic latent images formed on the photoconductors 5, visualizing the electrostatic latent images into yellow, magenta, cyan, and black toner images, respectively.

Simultaneously, as the print job starts, the secondary transfer backup roller 32 over which the intermediate transfer belt 30 is looped is driven and rotated counterclockwise in FIG. 1, rotating the intermediate transfer belt 30 in the rotation direction R1 by friction therebetween. The power supply applies a constant voltage or a constant current control voltage having a polarity opposite a polarity of the charged toner to the primary transfer rollers 31, creating a transfer electric field at the respective primary transfer nips formed between the photoconductors 5 and the primary transfer rollers 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a color toner image is formed on the outer circumferential surface of the intermediate transfer belt 30.

After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, dischargers discharge the outer circumferential surface of the respective photoconductors 5, initializing the surface potential thereof to render the photoconductors 5 to be ready for a next image forming operation.

On the other hand, the feed roller 11 disposed in the lower portion of the image forming apparatus 1 is driven and rotated to feed a sheet P from the paper tray 10 toward the registration roller pair 12 in the conveyance path R. The registration roller pair 12 halts the sheet P temporarily.

Thereafter, the registration roller pair 12 resumes rotation at a predetermined time to convey the sheet P to the secondary transfer nip at a time when the toner image formed on intermediate transfer belt 30 reaches the secondary transfer nip. The secondary transfer roller 36 is applied with a transfer voltage having a polarity opposite a polarity of the charged yellow, magenta, cyan, and black toners constituting the color toner image formed on the intermediate transfer belt 30, thus creating a transfer electric field at the secondary transfer nip. Thus, the yellow, magenta, cyan, and black toner images constituting the color toner image are secondarily transferred from the intermediate transfer belt 30 onto the sheet P collectively by the transfer electric field created at the secondary transfer nip. Alternatively, the secondary transfer backup roller 32 may be applied with a transfer voltage having a polarity identical to a polarity of the charged toner to secondarily transfer the color toner image from the intermediate transfer belt 30 onto the sheet P. After the secondary transfer of the color toner image from the intermediate transfer belt 30 onto the sheet P, the belt cleaner 35 removes residual toner failed to be transferred onto the sheet P and therefore remaining on the intermediate transfer belt 30 therefrom.

The sheet P bearing the color toner image is conveyed to the fixing device 20 that fixes the color toner image on the sheet P. Then, the sheet P bearing the fixed color toner image is ejected by the output roller pair 13 onto the outside of the image forming apparatus 1, that is, the output tray 14 that stocks the sheet P.

The above describes the image forming operation of the image forming apparatus 1 to form the color toner image on the sheet P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 2:
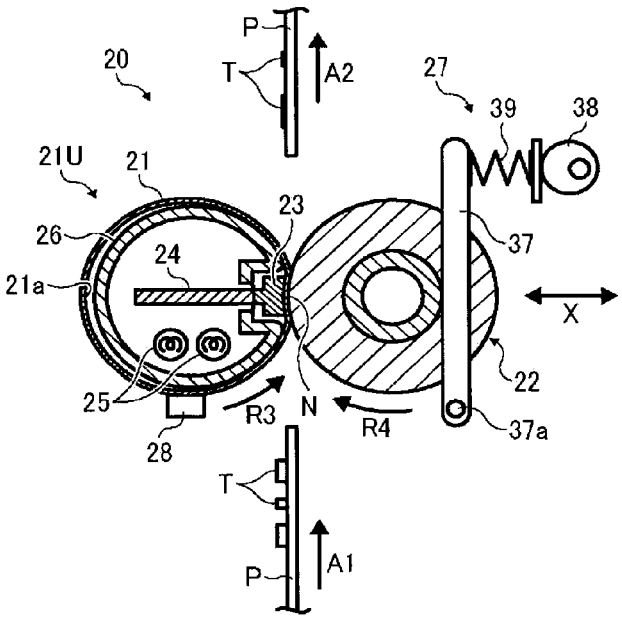
FIG. 2 is a schematic vertical sectional view of a fixing device installed in the image forming apparatus shown in FIG. 1.

With reference to FIG. 2, a description is provided of a construction of the fixing device 20 incorporated in the image forming apparatus 1 described above.

FIG. 2 is a schematic vertical sectional view of the fixing device 20. As shown in FIG. 2, the fixing device 20 includes a fixing belt 21 serving as a fixing rotator or a fixing member; a pressure roller 22 serving as an opposed rotator or an opposed member pressed against the fixing belt 21 to form a fixing nip N therebetween; a nip formation pad 23 disposed opposite the pressure roller 22 via the fixing belt 21 and contacting an inner circumferential surface of the fixing belt 21; a reinforcement 24 contacting and supporting the nip formation pad 23; a heater 25 disposed opposite the fixing belt 21 to heat the fixing belt 21; a thermal conductor 26 interposed between the heater 25 and the fixing belt 21 to conduct heat radiated from the heater 25 to the fixing belt 21; a pressurization assembly 27 to press the pressure roller 22 against the fixing belt 21; and a temperature sensor 28 serving as a temperature detector disposed opposite an outer circumferential surface of the fixing belt 21 to detect the temperature of the outer circumferential surface of the fixing belt 21. The fixing belt 21 and the components disposed inside a loop formed by the fixing belt 21, that is, the nip formation pad 23, the reinforcement 24, the heater 25, and the thermal conductor 26, may constitute a belt unit 21U separably coupled with the pressure roller 22.

A detailed description is now given of a configuration of the fixing belt 21.

The fixing belt 21 is a thin, flexible endless belt or film. The fixing belt 21 is made of heat resistant resin, heat resistant rubber, a compound of those, or the like. The fixing belt 21 is constructed of a base layer constituting an inner circumferential surface 21*a*; an elastic layer coating the base layer; and a release layer coating the elastic layer, which produce a total thickness of the fixing belt 21 not greater than about 1 mm. The base layer, having a thickness in a range of from about 30 micrometers to about 100 micrometers, is made of metal such as nickel and stainless steel or resin such as polyimide.

The elastic layer, having a thickness in a range of from about 100 micrometers to about 300 micrometers, is made of rubber such as silicone rubber, silicone rubber foam, and fluoro rubber. The elastic layer absorbs slight surface asperities of the fixing belt 21 at the fixing nip N, facilitating even heat conduction from the fixing belt 21 to a toner image T on a sheet P and thereby suppressing formation of an orange peel image on the sheet P.

The release layer, having a thickness in a range of from about 5 micrometers to about 50 micrometers, is made of tetrafluoroethylene-perfluoroalkylvinylether copolymer (PFA), polytetrafluoroethylene (PTFE), polyimide (PI), polyether imide (PEI), polyether sulfide (PES), or the like. A loop diameter of the fixing belt 21 is in a range of from about 15 mm to about 120 mm. According to this exemplary embodiment, the fixing belt 21 has a loop diameter of about 30 mm.

A detailed description is now given of a configuration of the pressure roller 22.

The pressure roller 22, having a diameter in a range of from about 30 mm to about 40 mm, is constructed of a hollow cored bar serving as a core and an elastic layer coating the cored bar. The elastic layer is made of silicone rubber foam, silicone rubber, fluoro rubber, or the like. Optionally, a thin release layer made of PFA, PTFE, or the like may coat the elastic layer. If the elastic layer is made of sponge such as silicone rubber foam, the elastic layer reduces pressure exerted at the fixing nip N, decreasing bending of the nip formation pad 23 by pressure from the pressure roller 22. Additionally, the elastic layer made of sponge enhances thermal insulation of the pressure roller 22, reducing heat conduction from the fixing belt 21 to the pressure roller 22 and thereby improving heating efficiency of the fixing belt 21.

The pressure roller 22 mounts a gear that engages a driving gear of a driver so that the pressure roller 22 is driven and rotated clockwise in FIG. 2 in a rotation direction R4. The pressure roller 22 is rotatably mounted on and supported by a side plate of the fixing device 20 through a bearing at each lateral end of the pressure roller 22 in an axial direction thereof. A heater such as a halogen heater may be situated inside the pressure roller 22. If the elastic layer of the pressure roller 22 is made of sponge such as silicone rubber foam, the elastic layer decreases pressure exerted to the fixing nip N, reducing bending of the nip formation pad 23. Additionally, the elastic layer made of sponge enhances thermal insulation of the pressure roller 22, reducing heat conduction from the fixing belt 21 to the pressure roller 22 and thereby improving heating efficiency of the fixing belt 21. As shown in FIG. 2, the loop diameter of the fixing belt 21 is equivalent to the diameter of the pressure roller 22. Alternatively, the loop diameter of the fixing belt 21 may be smaller than the diameter of the pressure roller 22. In this case, a curvature of the fixing belt 21 at the fixing nip N is greater than that of the pressure roller 22, facilitating separation of the sheet P ejected from the fixing nip N from the fixing belt 21. Yet alternatively, the loop diameter of the fixing belt 21 may be greater than the diameter of the pressure roller 22. Regardless of a relation between the loop diameter of the fixing belt 21 and the diameter of the pressure roller 22, pressure from the pressure roller 22 is not exerted to the thermal conductor 26.

A detailed description is now given of a configuration of the nip formation pad 23.

The nip formation pad 23 is mounted on and supported by the side plate of the fixing device 20 at each lateral end of the nip formation pad 23 in a longitudinal direction thereof parallel to an axial direction of the fixing belt 21. The nip formation pad 23 is made of heat resistant resin such as liquid crystal polymer or the like. An elastic member made of silicone rubber, fluoro rubber, or the like that is interposed between the nip formation pad 23 and the fixing belt 21 causes the outer circumferential surface of the fixing belt 21 to absorb slight surface asperities of the sheet P at the fixing nip N, facilitating even heat conduction from the fixing belt 21 to the toner image T on the sheet P and thereby suppressing formation of an orange peel image on the sheet P. The nip formation pad 23 includes an opposed face disposed opposite the pressure roller 22 and curved in cross-section to produce a recess corresponding to a curve of the pressure roller 22. Accordingly, the sheet P sandwiched between the curved fixing belt 21 and the curved pressure roller 22 is directed to the pressure roller 22 as the sheet P is ejected from the fixing nip N, suppressing a failure in which the sheet P ejected from the fixing nip N adheres to the fixing belt 21 and thereby facilitating separation of the sheet P from the fixing belt 21. Alternatively, the opposed face of the nip formation pad 23 disposed opposite the pressure roller 22 may be planar or constructed of a plane and a recess contiguous to the plane. As the nip formation pad 23 is contoured arbitrarily to produce the fixing nip N substantially parallel to an imaged side of the sheet P, the nip formation pad 23 prevents the sheet P from creasing. As the nip formation pad 23 is curved in cross-section to produce a recess, the nip formation pad 23 facilitates adhesion of the fixing belt 21 to the sheet P, enhancing fixing property of heating the fixing belt 21 and the sheet P quickly. Additionally, a curvature of the fixing belt 21 at an exit of the fixing nip N is greater than that of the pressure roller 22, facilitating separation of the sheet P ejected from the fixing nip N from the fixing belt 21.

A detailed description is now given of a configuration of the thermal conductor 26.

The thermal conductor 26 is a tube or a pipe having a thickness not greater than about 0.2 mm. The thermal conductor 26 may be a metal thermal conductor made of conductive metal such as aluminum, iron, and stainless steel. The thermal conductor 26 having the thickness not greater than about 0.2 mm conducts heat from the heater 25 to the fixing belt 21 effectively. The thermal conductor 26 is disposed in proximity to or in contact with the inner circumferential surface of the fixing belt 21 at a circumferential span on the fixing belt 21 other than the fixing nip N. At the fixing nip N, the thermal conductor 26 includes a recess accommodating the nip formation pad 23 and having a slit. At an ambient temperature, a gap between the fixing belt 21 and the thermal conductor 26 produced at the circumferential span on the fixing belt 21 other than the fixing nip N is greater than 0 mm and not greater than about 2 mm. Hence, the fixing belt 21 slides over the thermal conductor 26 in a decreased area, suppressing abrasion of the fixing belt 21 that may accelerate as the fixing belt 21 slides over the thermal conductor 26 in an increased area. Simultaneously, the fixing belt 21 is not isolated from the thermal conductor 26 with an excessively increased gap therebetween, suppressing degradation in heating efficiency in heating the fixing belt 21. Additionally, the thermal conductor 26 disposed in proximity to the fixing belt 21 retains a circular shape of the flexible fixing belt 21, reducing deformation and resultant degradation and breakage of the fixing belt 21.

In order to decrease resistance between the thermal conductor 26 and the fixing belt 21 sliding thereover, a slide face, that is, an outer circumferential surface, of the thermal conductor 26 may be made of a material having a decreased friction coefficient or the inner circumferential surface 21*a* of the fixing belt 21 may be coated with a surface layer made of a material containing fluorine. As shown in FIG. 2, the thermal conductor 26 is substantially circular in cross-section. Alternatively, the thermal conductor 26 may be polygonal in cross-section. If the fixing device 20 includes a separate component that conducts heat from the heater 25 to the fixing belt 21 evenly and stabilizes motion of the fixing belt 21 as it is driven, the fixing device 20 may employ a direct heating method in which the heater 25 heats the fixing belt 21 directly without the thermal conductor 26. In this case, the fixing device 20 reduces its total thermal capacity by a thermal capacity of the thermal conductor 26, heating the fixing belt 21 quickly and saving energy.

The thermal conductor 26 is mounted on and supported by the side plate of the fixing device 20 at each lateral end of the thermal conductor 26 in a longitudinal direction thereof parallel to the axial direction of the fixing belt 21. The heater 25 heats the thermal conductor 26 by radiation heat or light, which in turn heats the fixing belt 21. That is, the heater 25 heats the thermal conductor 26 directly and heats the fixing belt 21 indirectly through the thermal conductor 26. Output of the heater 25 is controlled based on the temperature of the outer circumferential surface of the fixing belt 21 detected by the temperature sensor 28. The temperature sensor 28 is a contact thermistor or the like disposed opposite the outer circumferential surface of the fixing belt 21. Alternatively, the temperature sensor 28 may be a non-contact thermistor or a non-contact thermopile. Thus, the fixing belt 21 is heated to a desired fixing temperature by the heater 25 controlled as described above. FIG. 2 illustrates a halogen heater used as the heater 25. Alternatively, other heaters may be used as the heater 25. For example, the heater 25 may be an induction heater, a ceramic heater, or the like.

A detailed description is now given of a configuration of the reinforcement 24.

The reinforcement 24 supports the nip formation pad 23 against pressure from the pressure roller 22. The reinforcement 24 has a length in a longitudinal direction thereof parallel to the axial direction of the fixing belt 21 that is equivalent to a length of the nip formation pad 23 in the longitudinal direction thereof. The reinforcement 24 is mounted on and supported by the side plate of the fixing device 20 at each lateral end of the reinforcement 24 in the longitudinal direction thereof. The reinforcement 24 presses against the pressure roller 22 via the nip formation pad 23 and the fixing belt 21, suppressing substantial deformation of the nip formation pad 23 at the fixing nip N by pressure from the pressure roller 22. The reinforcement 24 is made of metal having an increased mechanical strength, such as stainless steel and iron, to attain the advantages described above.

If the heater 25 is a halogen heater or the like that heats the fixing belt 21 by radiation heat, an opposed face of the reinforcement 24 disposed opposite the heater 25 is partially or entirely coated with an insulator or treated with bright annealing (BA) or mirror polishing. Accordingly, heat radiated from the heater 25 toward the reinforcement 24, that is, light that heats the reinforcement 24, is used to heat the thermal conductor 26, improving heating efficiency of heating the fixing belt 21 through the thermal conductor 26.

A detailed description is now given of a configuration of the pressurization assembly 27.

The pressurization assembly 27 includes a pressure lever 37, an eccentric cam 38, and a pressure spring 39. The pressure lever 37 is pivotably mounted on and supported by the side plate of the fixing device 20 such that the pressure lever 37 is pivotable about a shaft 37*a* at one end of the pressure lever 37 in a longitudinal direction thereof. A center of the pressure lever 37 in the longitudinal direction thereof contacts the bearing of the pressure roller 22. Another end of the pressure lever 37 in the longitudinal direction thereof is anchored with the pressure spring 39 anchored to a holder plate that contacts the eccentric cam 38.

As the driver rotates the eccentric cam 38, the pressure lever 37 rotates about the shaft 37*a*, moving the pressure roller 22 in a direction X. During a regular fixing job, the eccentric cam 38 is at a pressurization position shown in FIG. 2 to press the pressure roller 22 against the fixing belt 21, forming the desired fixing nip N at which the fixing belt 21 and the pressure roller 22 fix the toner image T on the sheet P under heat and pressure. Conversely, during removal of the jammed sheet P or in a standby mode in which the fixing device 20 waits for a fixing job, the eccentric cam 38 is rotated from the pressurization position shown in FIG. 2 by 180 degrees to separate the pressure roller 22 from the fixing belt 21, decreasing pressure exerted between the fixing belt 21 and the pressure roller 22. As pressure exerted at the fixing nip N is decreased during removal of the jammed sheet P or in the standby mode, a user can remove the jammed sheet P from the fixing device 20 readily. Further, the pressure roller 22 is pressed against the fixing belt 21 for a decreased time period during the standby mode, suppressing plastic deformation of the pressure roller 22.

A description is provided of a fixing operation of the fixing device 20.

As the image forming apparatus 1 depicted in FIG. 1 is powered on, the heater 25 is supplied with power and the driver starts driving and rotating the pressure roller 22 clockwise in FIG. 2 in the rotation direction R4. The fixing belt 21 is driven and rotated counterclockwise in FIG. 2 in a rotation direction R3 by friction between the fixing belt 21 and the pressure roller 22. Alternatively, the driver may also be connected to the fixing belt 21 to drive and rotate the fixing belt 21.

As shown in FIG. 1, the feed roller 11 picks up and feeds a sheet P from the paper tray 10 to the registration roller pair 12 that conveys the sheet P to the secondary transfer nip where a toner image T is secondarily transferred from the intermediate transfer belt 30 onto the sheet P. As shown in FIG. 2, the sheet P bearing the toner image T is conveyed in the sheet conveyance direction A1 while guided by a guide plate and enters the fixing nip N formed between the fixing belt 21 and the pressure roller 22 pressed against the fixing belt 21.

The toner image T is fixed on the sheet P under heat from the fixing belt 21 heated by the heater 25 through the thermal conductor 26 and pressure exerted from the fixing belt 21 and the pressure roller 22. The sheet P is ejected from the fixing nip N, conveyed in a sheet conveyance direction A2, and ejected onto the outside of the image forming apparatus 1. Thus, the fixing device 20 completes a series of fixing processes.

A description is provided of a temperature control of a fixing device using a comparative feedback control method.

Figure 3:
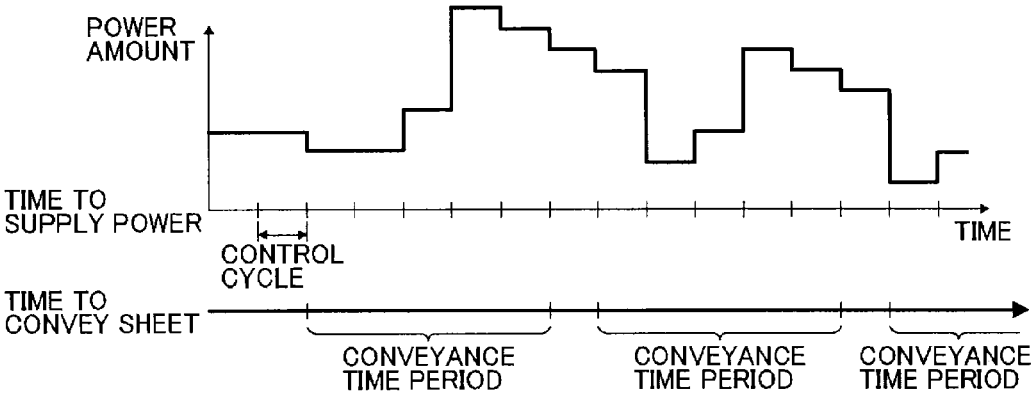
FIG. 3 Background Art
FIG. 3 is a diagram showing power control using a comparative proportional-integral-derivative controller.

FIG. 3 is a diagram showing power control using a comparative proportional-integral-derivative (PID) controller. The PID controller is a feedback controller. The PID controller involves three separate parameters: the proportional (P), the integral (I), and the differential (D). The PID controller calculates an error value as a difference between a temperature of the fixing belt 21 and a target temperature and changes an amount of power supplied to the heater 25 or a power supply time according to the difference.

When a difference between a temperature T1 of a fixing belt (e.g., the fixing belt 21) and a target temperature T0 is increased, the PID controller increases power supply, that is, a duty, to a heater (e.g., the heater 25) in the proportional control. Thereafter, when the temperature T1 of the fixing belt nearly reaches the target temperature T0, the PID controller decreases power supply to the heater in the differential control to prevent the temperature T1 of the fixing belt from exceeding the target temperature T0. The PID controller adjusts power supply to the heater to eliminate or minimize the difference between the temperature T1 of the fixing belt and the target temperature T0 in the integral control.

The PID controller controls power supply to the heater to decrease the difference, that is, a temperature ripple, between the temperature T1 of the fixing belt and the target temperature T0. However, when the temperature T1 of the fixing belt nearly reaches the target temperature T0, it is impossible to increase power supply to the heater substantially to heat the fixing belt. Accordingly, as shown in FIG. 3, when the temperature T1 of the fixing belt nearly reaches the target temperature T0, the PID controller increases power supply to the heater slowly and therefore it is difficult to increase the temperature of the fixing belt quickly at a time when the sheet P enters the fixing nip N. As the sheet P of a particular type enters the fixing device retained at a predetermined temperature, the sheet P may draw heat from the fixing belt and decrease the temperature of the fixing belt. Since it takes time for a temperature sensor (e.g., the temperature sensor 28) to detect the decreased temperature of the fixing belt under the PID controller, the fixing belt may suffer from temperature decrease temporarily. In the fixing device employing the thin fixing belt having a decreased thermal capacity to shorten a warm-up time to heat the fixing belt to a predetermined temperature and save energy, the fixing belt attains an improved responsiveness to output of the heater and is heated quickly as the heater heats the fixing belt. Accordingly, the comparative PID controller may not control the fixing device incorporating the thin fixing belt properly.

To address this circumstance, the fixing device 20 according to this exemplary embodiment has a configuration described below.

A description is provided of a configuration of a control for controlling the fixing device 20.

Figures 4, 5:
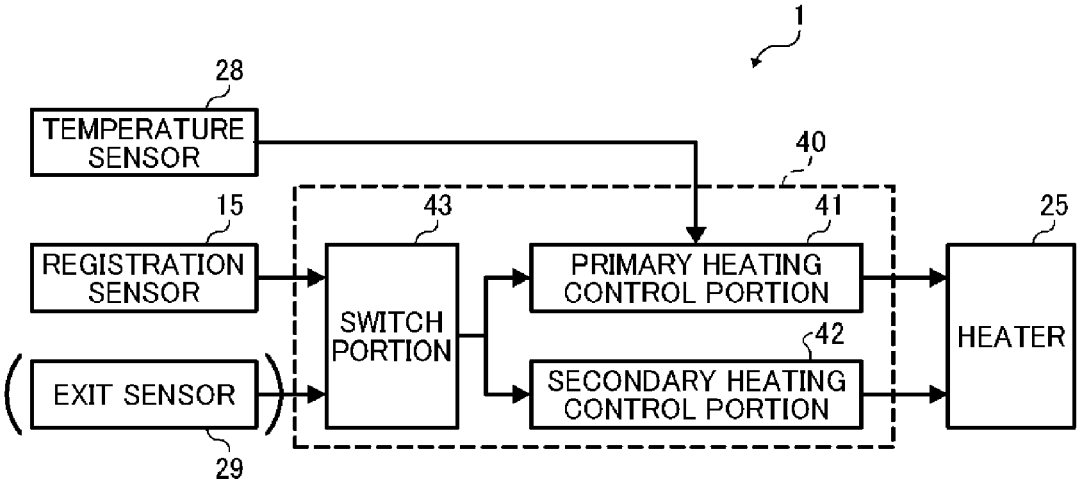
FIG. 4 is a block diagram of a controller incorporated in the image forming apparatus shown in FIG. 1.
FIG. 5 is a lookup table showing one example of an amount of power supplied to a heater incorporated in the fixing device shown in FIG. 2 that is determined according to the type of a sheet.

FIG. 4 is a block diagram of a controller 40 for controlling the fixing device 20. As shown in FIG. 4, the image forming apparatus 1 includes the controller 40, constructed of a central processing unit (CPU), a memory, and the like, that includes a primary heating control portion 41, a secondary heating control portion 42, and a switch portion 43.

A detailed description is now given of a configuration of the primary heating control portion 41.

The primary heating control portion 41 determines an amount of power supplied to the heater 25 based on a temperature of the fixing belt 21 detected by the temperature sensor 28 and supplies power in the determined amount to the heater 25 so that the heater 25 performs a primary heating H1. According to this exemplary embodiment, the primary heating H1 is performed under a proportional-integral (PI) controller. The PI controller is a simplification of the PID controller that involves two separate parameters: the proportional (P) and the integral (I). The PID controller may be employed instead of the PI controller. The PI controller calculates an amount of power supplied to the heater 25 defined by Duty (n) according to a formula (1) below.

$$\mathrm{Duty}(n)=\mathrm{Duty}(n-1)+kp\{T(n-1)-T(n)\}+ki\{T\mathrm{aim}-T(n)\} \quad (1)$$

In the formula (1) above, Duty (n−1) represents an amount of power calculated previously. T (n) represents a temperature of the fixing belt 21 detected presently. T (n−1) represents a temperature of the fixing belt 21 detected previously. Taim represents a target temperature of the fixing belt 21. kp represents a proportionality coefficient. ki represents an integral action coefficient.

The amount of power supplied to the heater 25 is calculated as a rate, that is, a duty, of a power supply time period per unit time. For example, when the amount of power supplied to the heater 25 is defined as 50 percent, power is supplied for a half of a control cycle. Alternatively, the amount of power supplied to the heater 25 may be controlled, not by adjusting the power supply time period, but by changing an electric current value, an electric voltage value, or a power value.

A detailed description is now given of a configuration of the secondary heating control portion 42.

The secondary heating control portion 42 supplies a preset amount of power to the heater 25 so that the heater 25 performs a secondary heating H2. Unlike the primary heating H1, the secondary heating H2 determines the amount of power supplied to the heater 25 irrespective of the temperature of the fixing belt 21 detected by the temperature sensor 28. For example, the amount of power supplied to the heater 25 is determined based on the type of the sheet P, for example, the size, paper weight, thickness, or the like of the sheet P.

FIG. 5 is a lookup table showing one example of the amount of power supplied to the heater 25 determined according to the type of the sheet P. As shown in FIG. 5, the amount of power supplied to the heater 25 is determined according to the type of the sheet P, that is, thin paper, plain paper 1, plain paper 2, medium thickness paper, and thick paper. As the thickness of the sheet P increases from thin paper to thick paper, the amount of heat drawn from the fixing belt 21 to the sheet P as the sheet P is conveyed through the fixing nip N increases. Accordingly, the amount of heat required by the fixing belt 21 increases as the thickness of the sheet P increases. To address this circumstance, the amount of power supplied to the heater 25 increases as the thickness of the sheet P increases.

A detailed description is now given of a configuration of the switch portion 43.

The switch portion 43 switches between the primary heating H1 and the secondary heating H2 based on detection data of the sheet P sent from a registration sensor 15. As shown in FIG. 1, the registration sensor 15 is situated upstream from and in proximity to the registration roller pair 12 in the sheet conveyance direction A1. The registration sensor 15 serves as a recording medium supply detector that detects the sheet P conveyed from the paper tray 10. The registration sensor 15 may be a contact sensor including a pivotable feeler or a non-contact sensor including a permeation or reflection optical sensor.

A description is provided of a reference control method for controlling the heater 25.

Figure 6:
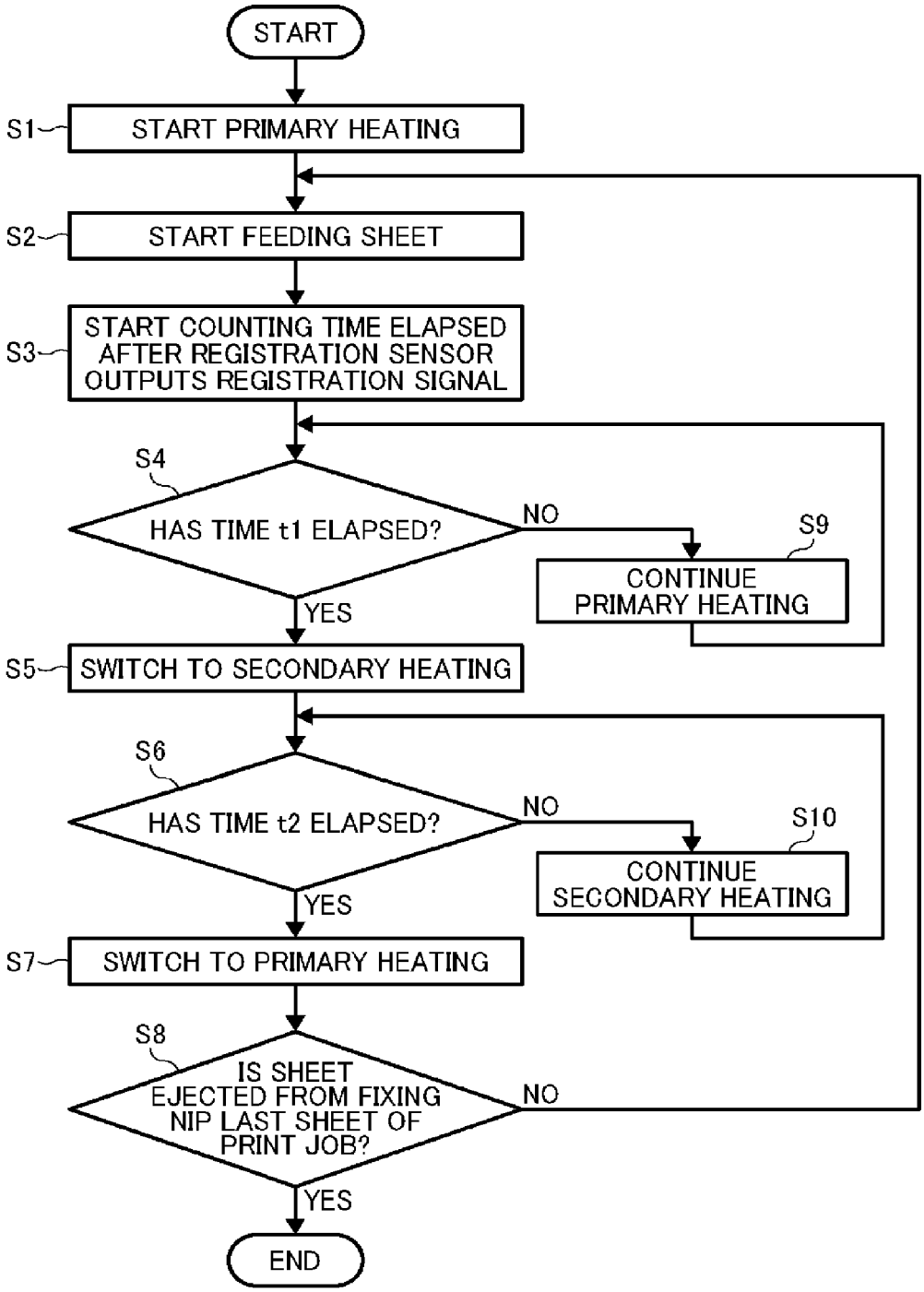
FIG. 6 is a flowchart showing a reference control method for controlling the heater incorporated in the fixing device shown in FIG. 2.
Figure 7:
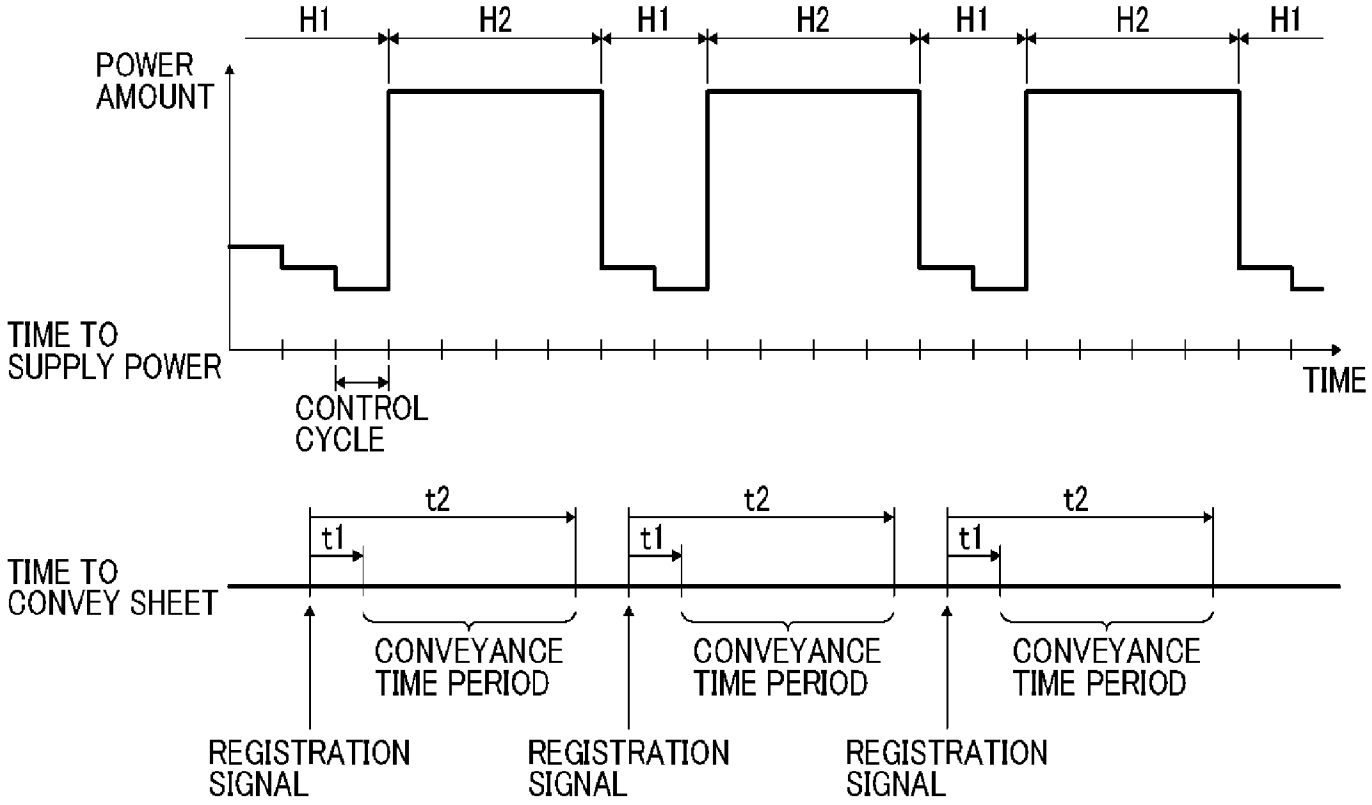
FIG. 7 is a timing chart showing the reference control method shown in FIG. 6.

FIG. 6 is a flowchart showing the reference control method. FIG. 7 is a timing chart showing a time to supply power to the heater 25, an amount of power supplied to the heater 25, and a time to convey the sheet P to the fixing nip N.

Upon receipt of a print job, the fixing device 20 starts control processes to perform a fixing operation to fix a toner image T on a sheet P. As shown in FIG. 6, in step S1, the controller 40 starts controlling the heater 25 to perform the primary heating H1 (e.g., the PI controller). As described above, in the primary heating H1, the temperature sensor 28 detects the temperature of the fixing belt 21 and the primary heating control portion 41 of the controller 40 calculates the amount of power supplied to the heater 25 according to the formula (1) above based on the detected temperature of the fixing belt 21.

In step S2, the feed roller 11 starts feeding a sheet P from the paper tray 10 to the registration roller pair 12. When the registration sensor 15 detects the sheet P, the registration sensor 15 outputs a registration signal serving as a sheet detection signal. In step S3, the controller 40 starts counting a time elapsed after the registration sensor 15 outputs the registration signal.

For example, the controller 40 (e.g., the switch portion 43) counts a time t1 taken from output of the registration signal until a leading edge of the sheet P enters the fixing nip N of the fixing device 20 and a time t2 taken from output of the registration signal until a trailing edge of the sheet P is ejected from the fixing nip N. As shown in FIG. 7, by counting the times t1 and t2, the controller 40 recognizes an entry time when the sheet P enters the fixing nip N and an ejection time when the sheet P is ejected from the fixing nip N. Alternatively, the controller 40 may determine the ejection time when the sheet P is ejected from the fixing nip N based on detection data from an exit sensor 29 depicted in FIG. 1. The exit sensor 29 is situated downstream from and in proximity to the fixing device 20 in the sheet conveyance direction A1. The exit sensor 29 serves as a recording medium ejection detector that detects the sheet P ejected from the fixing device 20.

In step S4, the controller 40 determines whether or not the time t1 has elapsed after the controller 40 starts counting. If the time t1 has elapsed and the sheet P has entered the fixing nip N (YES in S4), the switch portion 43 switches from the primary heating H1 to the secondary heating H2 in step S5. In the secondary heating H2, the secondary heating control portion 42 of the controller 40 refers to the table shown in FIG. 5 and supplies the amount of power preset according to the type of the sheet P to the heater 25. The controller 40 may determine the type of the sheet P to be supplied to the fixing device 20 based on an instruction input by a user or the like through a control panel or detection data sent from a sheet type detector that detects the type of the sheet P. For example, the sheet type detector may detect the rigidity of the sheet P. Since the rigidity of the sheet P varies depending on the type (e.g., the material and thickness) of the sheet P, rigidities of various types of sheets P are measured in advance. The controller 40 compares the rigidity of the sheet P detected by the sheet type detector with the measured rigidities, determining the type of the sheet P.

If the time t1 has not elapsed (NO in S4), the controller 40 continues the primary heating H1 in step S9.

In step S6, the controller 40 determines whether or not the time t2 has elapsed after the controller 40 starts counting. If the time t2 has elapsed and the sheet P has been ejected from the fixing nip N (YES in step S6), the switch portion 43 switches from the secondary heating H2 to the primary heating H1 in step S7.

If the time t2 has not elapsed (NO in S6), the controller 40 continues the secondary heating H2 in step S10.

In step S8, the controller 40 determines whether or not the sheet P ejected from the fixing nip N is the last sheet P of the print job. If the sheet P is not the last sheet P of the print job and therefore there is a subsequent sheet P (NO in step S8), the feed roller 11 starts feeding the subsequent sheet P from the paper tray 10 to the registration roller pair 12 in step S2. The controller 40 performs switching between the primary heating H1 and the secondary heating H2 described above also for the subsequent sheet P. Contrarily, if the sheet P ejected from the fixing nip N is the last sheet P of the print job (YES in step S8), the control processes for the fixing operation are finished.

As described above, according to the fixing device 20 employing the reference control method, during the identical print job, the controller 40 switches between the primary heating H1 and the secondary heating H2 of the heater 25 based on the registration signal. As shown in FIG. 7, the controller 40 controls the heater 25 to perform the secondary heating H2 mainly during the conveyance time period when the sheet P is conveyed through the fixing nip N. Conversely, the controller 40 controls the heater 25 to perform the primary heating H1 mainly before the sheet P enters the fixing nip N and after the sheet P is ejected from the fixing nip N. "During the identical print job" defines a time period elapsed after the feed roller 11 serving as a recording medium feeder starts feeding the first sheet P of the print job until the trailing edge of the last sheet P of the identical print job is ejected from the fixing nip N of the fixing device 20. If the print job prints on a single sheet P, "during the identical print job" defines a time period elapsed after the feed roller 11 starts feeding the single sheet P of the print job until the trailing edge of the single sheet P is ejected from the fixing nip N of the fixing device 20.

During the secondary heating H2 performed while the sheet P is conveyed through the fixing nip N, the controller 40 supplies a preset amount of power to the heater 25 irrespective of the temperature of the fixing belt 21 detected by the temperature sensor 28 as shown in FIG. 7. Accordingly, compared to the comparative control method shown in FIG. 3, the amount of power supplied to the heater 25 is increased substantially. Consequently, the heater 25 heats the fixing belt 21 quickly as the conveyance time period starts, suppressing temperature decrease of the fixing belt 21.

Conversely, the amount of power supplied to the heater 25 during the primary heating H1 is determined based on the temperature of the fixing belt 21 detected by the temperature sensor 28. Accordingly, before the sheet P enters the fixing nip N and after the sheet P is ejected from the fixing nip N, the controller 40 determines the amount of power supplied to the heater 25 based on the temperature of the fixing belt 21 detected by the temperature sensor 28, preventing the fixing belt 21 from overshooting or overheating to a temperature substantially greater than a target temperature and thereby stabilizing the temperature of the fixing belt 21.

A description is provided of another reference control method for controlling the heater 25.

Figure 8:
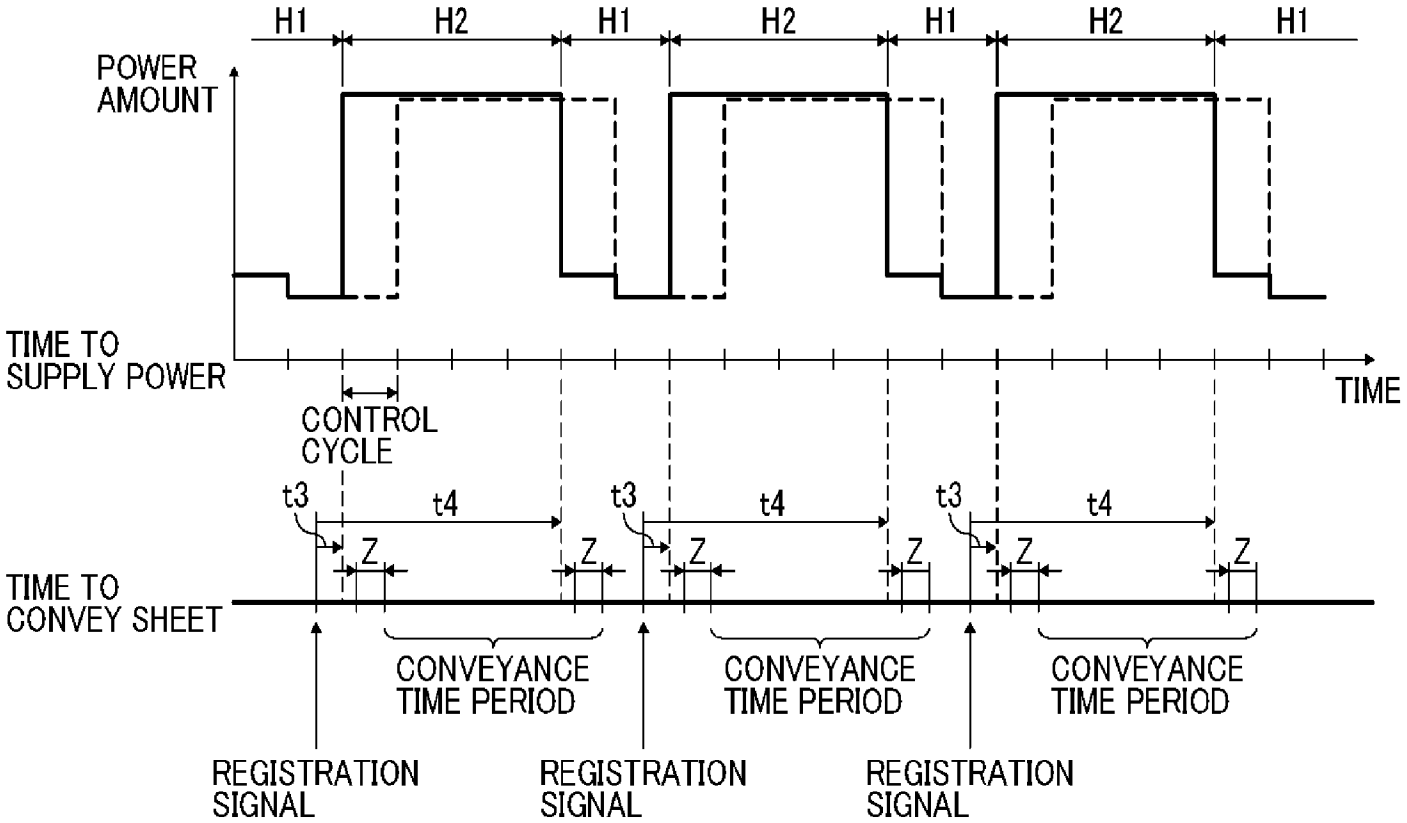
FIG. 8 is a timing chart showing another reference control method for controlling the heater incorporated in the fixing device shown in FIG. 2.

FIG. 8 is a timing chart showing a time to supply power to the heater 25, an amount of power supplied to the heater 25, and a time to convey the sheet P to the fixing nip N. It takes a certain time period after the heater 25 is supplied with power to generate heat until heat is conducted to the surface of the fixing belt 21. The time period taken until the temperature of the surface of the fixing belt 21 starts increasing upon start of power supply to the heater 25 is hereinafter referred to as "a heat conduction time period". The heat conduction time period varies depending on the thickness, thermal conductivity, or the like of the fixing belt 21. In order to conduct heat generated by power supply in the secondary heating H2 to the leading edge of the sheet P, power supply to the heater 25 need to start at a time earlier than entry of the leading edge of the sheet P to the fixing nip N by the heat conduction time period.

To address this circumstance, according to the reference control method shown in FIG. 8, considering a heat conduction time period Z to conduct heat to the fixing belt 21, a primary switching from the primary heating H1 to the secondary heating H2, that is, initial power supply in the secondary heating H2, is conducted at a time earlier than entry of the leading edge of the sheet P to the fixing nip N by the heat conduction time period Z. In FIG. 8, the time to supply power indicated by the broken line is equivalent to the time to supply power indicated by the solid line in FIG. 7 set without considering the heat conduction time period Z, which is illustrated for comparison. According to the reference control method shown in FIG. 8, times t3 and t4 counted from output of the registration signal are shortened compared to the times t1 and t2 according to the reference control method shown in FIG. 7. Hence, a secondary switching from the secondary heating H2 to the primary heating H1 and the primary switching from the primary heating H1 to the secondary heating H2 are performed at a time earlier by a single control cycle. Accordingly, the primary switching to the secondary heating H2 is conducted at a time earlier than entry of the leading edge of the sheet P to the fixing nip N by the heat conduction time period Z. Consequently, heat generated by power supplied in the secondary heating H2 is conducted to the leading edge of the sheet P.

A description is provided of a control method performed by the fixing device 20 according to an exemplary embodiment of this disclosure.

Figure 9:
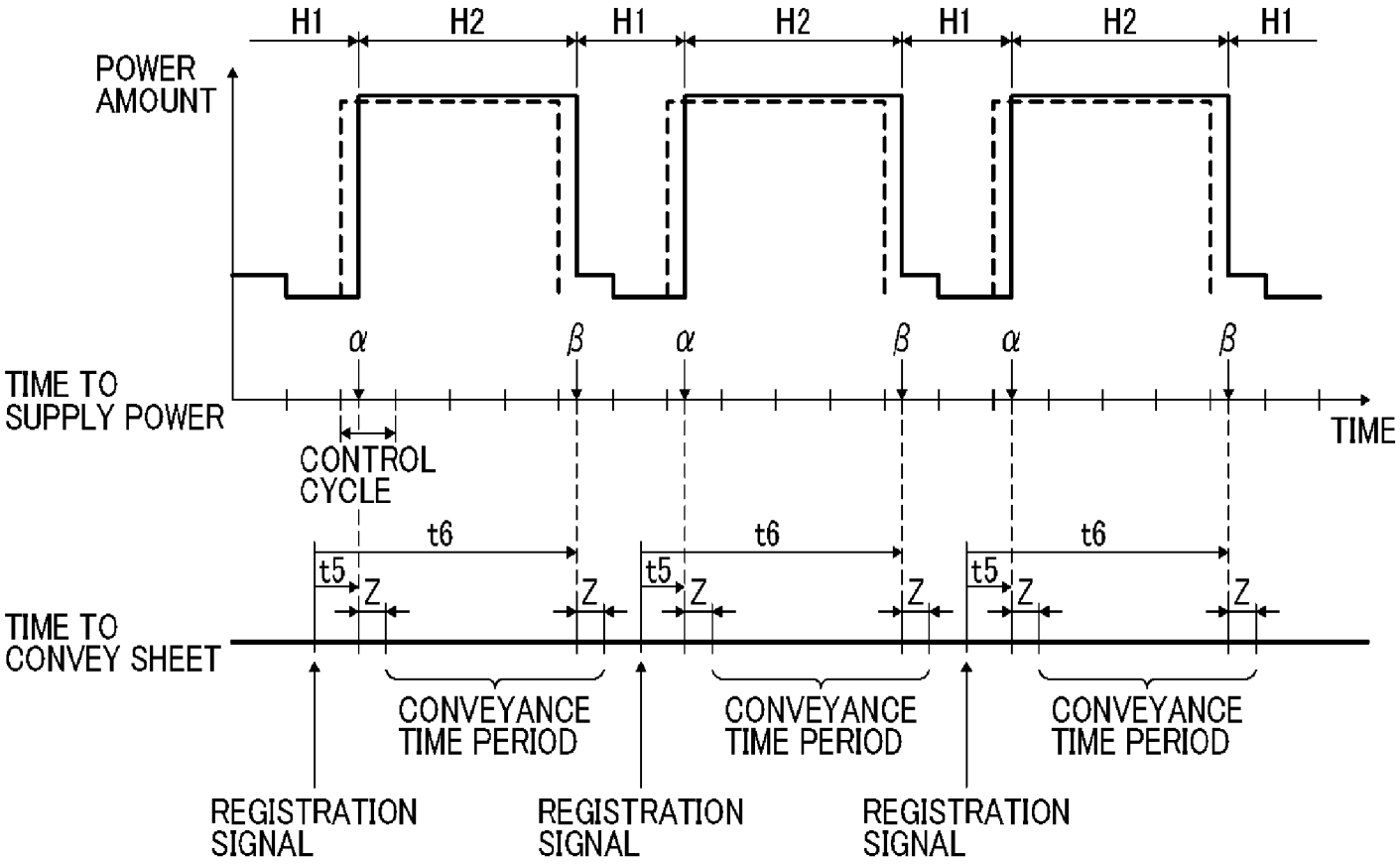
FIG. 9 is a timing chart showing a control method performed by the fixing device shown in FIG. 2 according to an exemplary embodiment of this disclosure.

FIG. 9 is a timing chart showing a time to supply power to the heater 25, an amount of power supplied to the heater 25, and a time to convey the sheet P to the fixing nip N. According to the reference control method shown in FIG. 8, the secondary heating H2 starts earlier by considering the heat conduction time period Z. It is more preferable that heat generated by power supplied to the heater 25 for the secondary heating H2 is conducted to the leading edge of the sheet P entering the fixing nip N. Accordingly, power is not supplied to the heater 25 earlier unnecessarily, suppressing overheating of the fixing belt 21 and saving energy more effectively. However, since power supply to the heater 25 is performed per control cycle, power supply is not always performed at a desired time determined by considering the heat conduction time period Z.

To address this circumstance, under the control method according to this exemplary embodiment shown in FIG. 9, the control cycle is reset to switch to the secondary heating H2 at a desired power supply time α considering the heat conduction time period Z. For example, a power supply time to start the primary heating H1 and the secondary heating H2 is determined according to a preset control cycle. However, if the preset control cycle is different from the desired power supply time α considering the heat conduction time period Z, the primary switching to the secondary heating H2, that is, an initial power supply in the secondary heating H2, is conducted at a time different from the preset control cycle.

Accordingly, even if the present control cycle is 400 msec, the primary switching to the secondary heating H2 is conducted at a control cycle of 100 msec, 200 msec, 300 msec, or others within 400 msec, irrespective of the preset control cycle of 400 msec. The primary switching to the secondary heating H2 is determined by counting a time t5 from a registration signal set based on the size, the conveyance speed, or the like of the sheet P. Control processes of the control method shown in FIG. 9 are equivalent to those of the reference control method shown in FIG. 6 and therefore a description thereof is omitted.

As described above, even if the control cycle is different from the desired power supply time α considering the heat conduction time period Z, the control cycle is reset to switch to the secondary heating H2 at the desired power supply time α. For example, the primary switching to the secondary heating H2 is conducted at the power supply time α earlier than entry of the leading edge of the sheet P to the fixing nip N by the heat conduction time period Z. In FIG. 9, the time to supply power indicated by the broken line is equivalent to the time not to reset the control cycle indicated by the solid line in FIG. 8, which is illustrated for comparison.

Additionally, according to this exemplary embodiment, the secondary switching to the primary heating H1, that is, finishing of the secondary heating H2, is conducted at a time different from the preset control cycle. For example, the secondary switching to the primary heating H1 is conducted at a time β earlier than ejection of the trailing edge of the sheet P from the fixing nip N by the heat conduction time period Z, irrespective of the preset control cycle. Accordingly, the secondary heating H2 finishes at the desired time β considering the heat conduction time period Z. The secondary switching to the primary heating H1 is determined by counting a time t6 from a registration signal set based on the size, the conveyance speed, or the like of the sheet P.

As described above, according to this exemplary embodiment, in addition to the advantages of the reference control method described above, switching between the primary heating H1 and the secondary heating H2 is conducted at a time different from the preset control cycle. Accordingly, heat conducted from the heater 25 to the fixing belt 21 in the secondary heating H2 is conducted from the fixing belt 21 to the sheet P at a desired time considering the heat conduction time period Z. Consequently, heat is not conducted to the fixing belt 21 unnecessarily, suppressing overheating of the fixing belt 21 and saving energy more effectively.

Such reset of the control cycle is advantageous especially for a fixing device incorporating a halogen heater serving as a heater. It is difficult to control the halogen heater using a minute control cycle such as 10 msec due to its responsiveness. Accordingly, if power is supplied to the halogen heater based on its control cycle, a power supply time may deviate from a desired power supply time. To address this circumstance, the control cycle of the halogen heater is reset under the control method described above to supply power to the halogen heater at a desired time, attaining substantial advantages.

Similar to the reference control method described above, under the control method according to this exemplary embodiment, the secondary heating H2 supplies a preset amount of power to the heater 25, increasing the amount of power supplied to the heater 25 substantially as needed to heat the fixing belt 21 quickly.

The feedback control using the PID controller and the PI controller intentionally increases a calculated amount of power supplied to the heater 25 by increasing the target temperature of the fixing belt 21, for example, thus increasing an amount of heat generation of the heater 25. However, the control method according to this exemplary embodiment differs from the feedback control using the PID controller and the PI controller. For example, the control method according to this exemplary embodiment performs the secondary heating H2 independently from the primary heating H1 (e.g., the PI controller), supplying the preset amount of power to the heater 25 irrespective of a relative relation between the temperature of the fixing belt 21 detected by the temperature sensor 28 and the target temperature of the fixing belt 21 and thus heating the fixing belt 21 quickly. Hence, during an identical print job, it is unnecessary to change the target temperature of the fixing belt 21 appropriate for fixing the toner image T on the sheet P and therefore the target temperature of the fixing belt 21 is not changed to switch between the primary heating H1 and the secondary heating H2.

A description is provided of a control method performed by the fixing device 20 according to another exemplary embodiment of this disclosure.

Figures 10, 11:
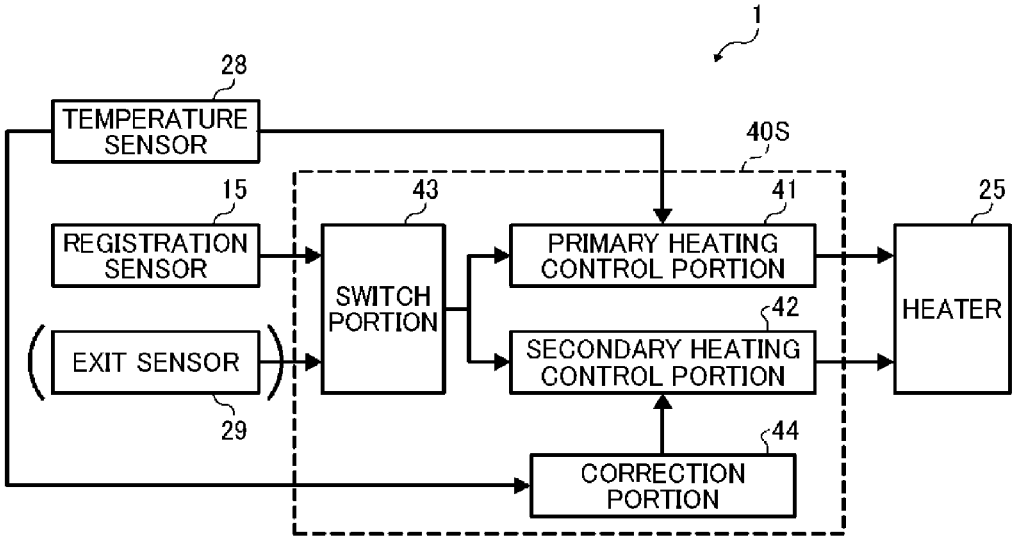
FIG. 10 is a block diagram of a controller for controlling the fixing device shown in FIG. 2 according to another exemplary embodiment of this disclosure.
FIG. 11 is a lookup table showing one example of a correction amount of power supplied to the heater that is corrected by the controller shown in FIG. 10.

FIG. 10 is a block diagram of a controller 40S for controlling the fixing device 20. As shown in FIG. 10, the controller 40S includes a correction portion 44 in addition to the primary heating control portion 41, the secondary heating control portion 42, and the switch portion 43 shown in FIG. 4. The correction portion 44 corrects the preset amount of power in the secondary heating H2 as needed. For example, the correction portion 44 corrects the amount of power based on a difference between the temperature of the fixing belt 21 detected by the temperature sensor 28 and the target temperature of the fixing belt 21 appropriate for fixing the toner image T on the sheet P (hereinafter referred to as a temperature difference of the fixing belt 21), which is obtained by subtracting the target temperature of the fixing belt 21 from the detected temperature of the fixing belt 21.

FIG. 11 is a lookup table showing one example of a correction amount of power supplied to the heater 25. The correction amount of power shown in FIG. 11 defines an amount of power to be added to or subtracted from a preset basic amount of power shown in FIG. 5. That is, an amount of power supplied to the heater 25 (hereinafter referred to as a supply amount of power) is calculated by adding the correction amount of power to the basic amount of power. For example, as shown in FIG. 5, when the type of the sheet P is thin paper, the basic amount of power is 450 W. As shown in FIG. 11, when the temperature difference of the fixing belt 21 is minus 7 degrees centigrade, the correction amount of power is plus 50 W. Hence, the supply amount of power is 500 W that is obtained by adding 50 W as the correction amount of power to 450 W as the basic amount of power. When the temperature difference of the fixing belt 21 is negative, an increased amount of heat is needed to heat the fixing belt 21 to the target temperature. Accordingly, the correction amount of power is added to the basic amount of power to increase the supply amount of power. Conversely, when the temperature difference of the fixing belt 21 is positive, power supply is barely needed. Accordingly, the correction amount of power is subtracted from the basic amount of power to decrease the supply amount of power.

A relation between the temperature difference of the fixing belt 21 and the correction amount of power shown in FIG. 11 is one example of a case in which sheets P are conveyed with a particular interval between consecutive sheets P and the fixing belt 21 stores a particular amount of heat. As the interval between the sheets P and storage of heat of the fixing belt 21 change, the appropriate supply amount of power changes. Hence, it is preferable to change the correction amount of power for each temperature difference range shown in FIG. 11. In order to change the correction amount of power, a plurality of tables like the table shown in FIG. 11 may be prepared according to the interval between the sheets P and storage of heat of the fixing belt 21. Alternatively, based on a single table for a particular interval of the sheets P and a particular storage of heat of the fixing belt 21, the correction amount of power may be changed by multiplication of a correction coefficient if the interval between the sheets P and storage of heat of the fixing belt 21 change.

Figure 12:
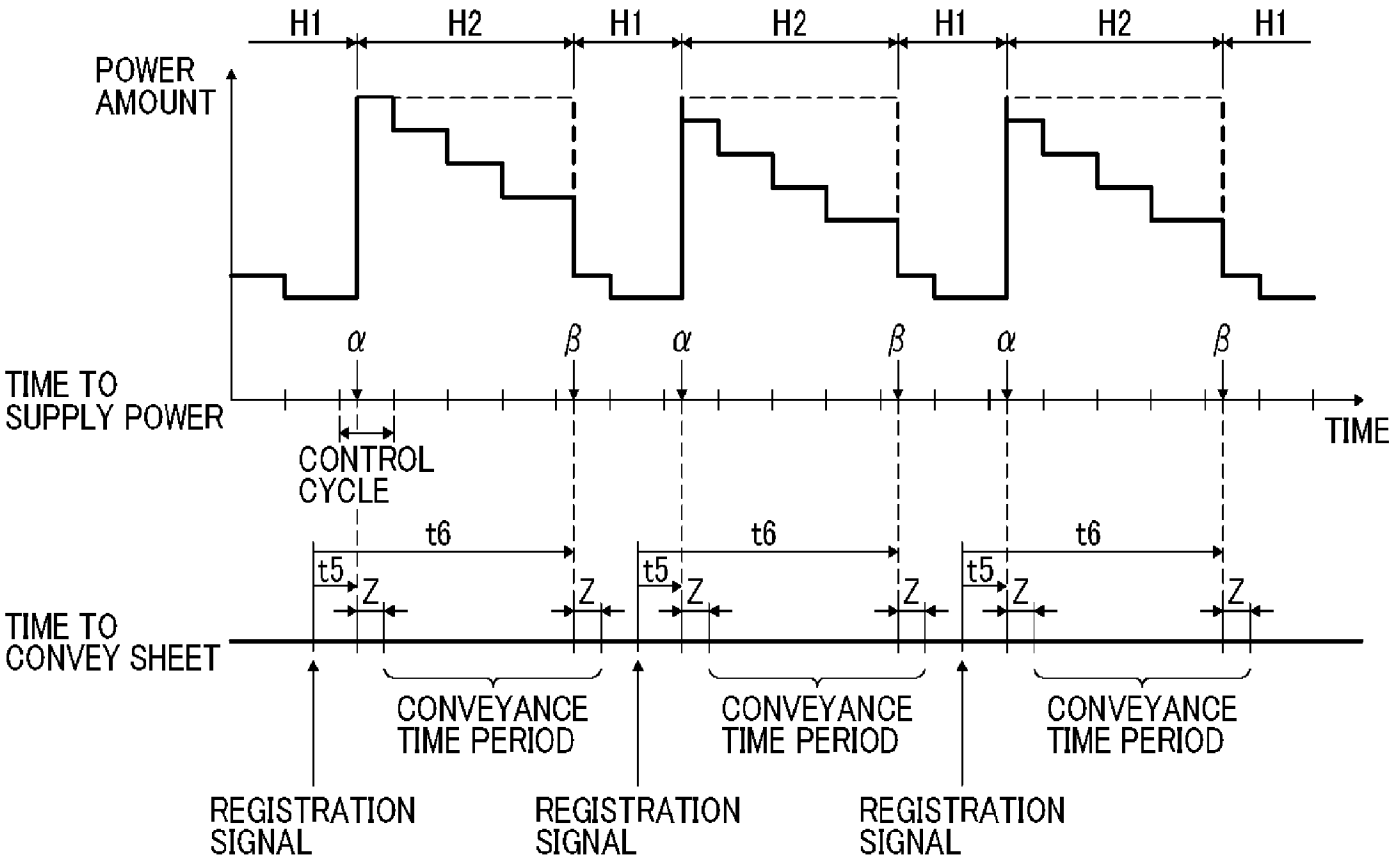
FIG. 12 is a timing chart showing one example of a correction method for correcting a supply amount of power supplied to the heater that is performed by the controller shown in FIG. 10.

FIG. 12 is a timing chart showing one example of a correction method for correcting the supply amount of power supplied to the heater 25. FIG. 12 illustrates, for comparison, the supply amount of power when correction is not performed with the broken line.

The supply amount of power in the secondary heating H2 is corrected by determining the correction amount of power per control cycle based on information about the temperature difference of the fixing belt 21, the interval between the sheets P, and storage of heat of the fixing belt 21. For example, as shown in FIG. 12, when the fixing belt 21 stores a certain amount of heat after initial power supply to the heater 25 in the secondary heating H2, the supply amount of power is decreased stepwise thereafter, suppressing overheating of the fixing belt 21. When a second sheet P or a subsequent sheet P of a print job is conveyed through the fixing nip N, since the fixing belt 21 stores more heat than when a first sheet P is conveyed through the fixing nip N, the supply amount of power supplied initially in the secondary heating H2 is corrected into an amount of power smaller than an amount of power supplied during conveyance of the first sheet P. When the interval between the sheets P is decreased, if an identical amount of power continues to be supplied, the fixing belt 21 may suffer from overheating. To address this circumstance, it is preferable to correct the supply amount of power properly. Correction of the supply amount of power is not limited to the correction method shown in FIG. 12. For example, the supply amount of power may be corrected properly based on various factors such as the temperature and the conveyance speed of the sheet P other than the factors described above.

The present disclosure is not limited to the details of the exemplary embodiments described above, and various modifications and improvements are possible.

For example, the exemplary embodiments described above are advantageous especially for fixing devices employing a thin fixing rotator having a decreased thermal capacity (e.g., a fixing belt or a fixing roller having a thickness not greater than about 300 micrometers) to shorten the warm-up time and save energy. In such fixing devices, the fixing rotator attains an improved responsiveness to output of a heater and is heated quickly as the heater heats the fixing belt. Hence, the fixing devices, by employing the control methods according to the exemplary embodiments described above, allow the heater to heat the fixing rotator quickly at a desired time at which the fixing rotator is heated to the target temperature as the sheet P enters the fixing nip N, attaining high quality fixing and saving energy.

With reference to FIGS. 13 to 16, a description is provided of variations of the fixing device 20 that incorporate a fixing belt.

Figure 13:
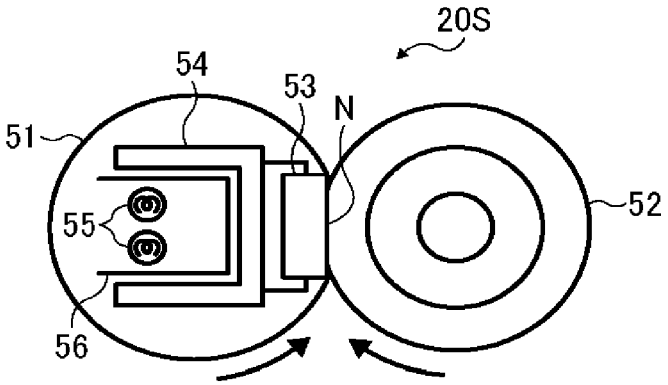
FIG. 13 is a schematic vertical sectional view of a fixing device as a first variation of the fixing device shown in FIG. 2.

FIG. 13 is a schematic vertical sectional view of a fixing device 20S incorporating a fixing belt 51. As shown in FIG. 13, the fixing device 20S includes the fixing belt 51; a pressure roller 52 contacting an outer circumferential surface of the fixing belt 51; a nip formation pad 53 contacting an inner circumferential surface of the fixing belt 51 and pressing against the pressure roller 52 via the fixing belt 51 to form a fixing nip N between the fixing belt 51 and the pressure roller 52; a reinforcement 54 contacting the nip formation pad 53 to support the nip formation pad 53; a halogen heater 55 to heat the fixing belt 51; and a reflector 56 to reflect heat or light radiated from the halogen heater 55 toward the fixing belt 51.

Unlike the fixing device 20 depicted in FIG. 2, the fixing device 20S does not incorporate the thermal conductor 26 disposed opposite the inner circumferential surface of the fixing belt 51. Hence, the halogen heater 55 heats the fixing belt 51 directly. Accordingly, the fixing device 20S further shortens a warm-up time taken to heat the fixing belt 51 to a predetermined fixing temperature appropriate for fixing a toner image on a sheet from an ambient temperature after the image forming apparatus 1 is powered on and a first print time taken to output the sheet bearing the fixed toner image upon receipt of a print job through preparation for a print operation and the subsequent print operation. The reflector 56 reflects heat or light radiated from the halogen heater 55 to the reinforcement 54 toward the fixing belt 51, increasing an amount of light irradiating the fixing belt 51 and thereby facilitating heating of the fixing belt 51. Additionally, the reflector 56 suppresses conduction of heat from the halogen heater 55 to the reinforcement 54 and the like, saving more energy. Alternatively, the reinforcement 54 may be produced with a through-hole through which heat or light from the halogen heater 55 travels to the nip formation pad 53 to heat the nip formation pad 53. Yet alternatively, the nip formation pad 53 may be made of a conductive material such as aluminum and copper to conduct heat to the fixing belt 51, thus heating the fixing belt 51 at the fixing nip N effectively.

Figure 14:
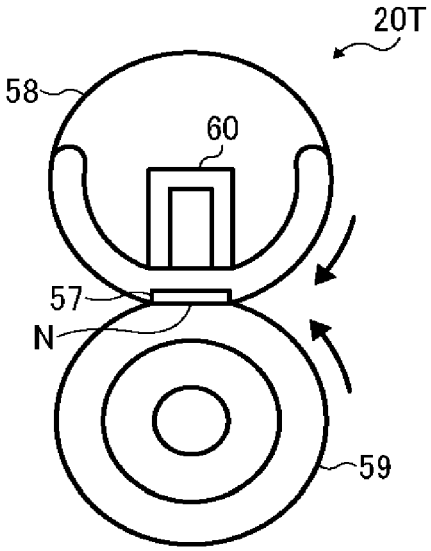
FIG. 14 is a schematic vertical sectional view of a fixing device as a second variation of the fixing device shown in FIG. 2.

FIG. 14 is a schematic vertical sectional view of a fixing device 20T incorporating a fixing belt 58. As shown in FIG. 14, the fixing device 20T includes a sheet heat generator 57 serving as a heater that heats the fixing belt 58. The sheet heat generator 57 includes a ceramic heater. A reinforcement 60 supports the sheet heat generator 57 such that the sheet heat generator 57 contacts an inner circumferential surface of the fixing belt 58 and presses against a pressure roller 59 via the fixing belt 58 to form a fixing nip N between the fixing belt 58 and the pressure roller 59. The sheet heat generator 57 and the reinforcement 60 also serve as a nip formation member that forms the fixing nip N between the fixing belt 58 and the pressure roller 59. The sheet heat generator 57 heats the fixing belt 58 locally at the fixing nip N.

Figure 15:
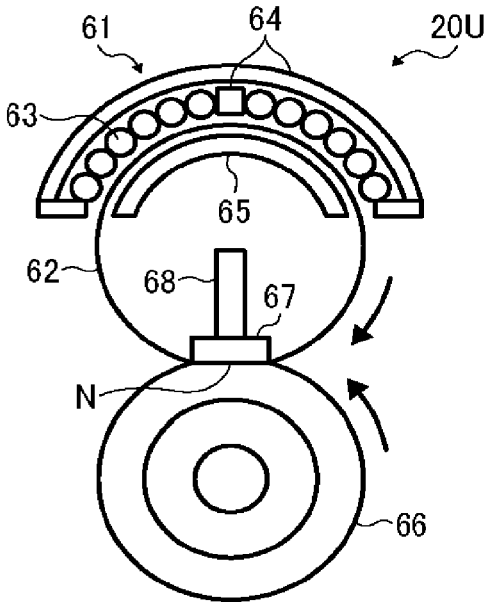
FIG. 15 is a schematic vertical sectional view of a fixing device as a third variation of the fixing device shown in FIG. 2.

FIG. 15 is a schematic vertical sectional view of a fixing device 20U incorporating a fixing belt 62. As shown in FIG. 15, the fixing device 20U includes an induction heater 61 serving as a heater that heats the fixing belt 62 by electromagnetic induction heating. The induction heater 61 includes a coil 63 serving as an exciting member disposed opposite an outer circumferential surface of the fixing belt 62; a ferrite core 64 to guide a magnetic field generated by the coil 63 to a heat generation layer of the fixing belt 62 to prevent the magnetic field from escaping to an outside of the fixing device 20U; and a thermosensitive magnet 65 disposed opposite an inner circumferential surface of the fixing belt 62. As the coil 63 receives a high-frequency alternating current from a high-frequency power supply, the coil 63 creates an alternating magnetic field that generates an eddy current in the heat generation layer of the fixing belt 62 and the thermosensitive magnet 65, thus heating the fixing belt 62 by electromagnetic induction heating. Like the fixing device 20S depicted in FIG. 13, the fixing device 20U includes a nip formation pad 67 and a reinforcement 68 disposed opposite the inner circumferential surface of the fixing belt 62. The nip formation pad 67 presses against a pressure roller 66 via the fixing belt 62 to form a fixing nip N between the fixing belt 62 and the pressure roller 66. The reinforcement 68 contacts and supports the nip formation pad 67.

The fixing devices 20S, 20T, and 20U depicted in FIGS. 13, 14, and 15, respectively, incorporate the fixing belts 51, 58, and 62 rotatable about a single shaft like the fixing belt 21 of the fixing device 20 depicted in FIG. 2. That is, each of the fixing belts 51, 58, and 62 is a free belt rotatable about the single shaft, not a belt stretched taut across a plurality of rollers or the like and rotatable about two or more shafts. The exemplary embodiments described above are also applicable to other fixing devices incorporating a fixing rotator other than the free belt rotatable about the single shaft as shown in FIG. 16.

Figure 16:
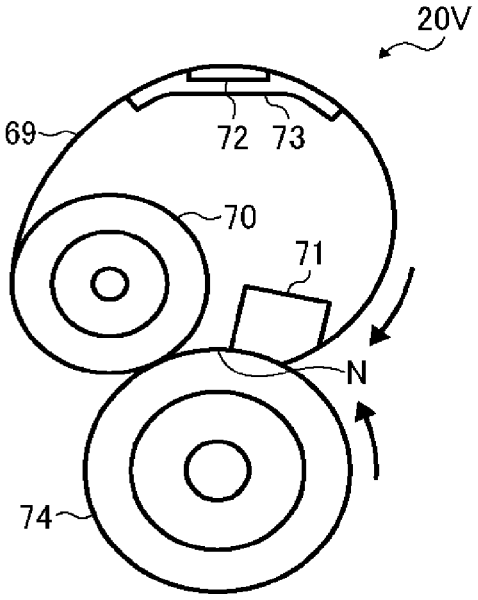
FIG. 16 is a schematic vertical sectional view of a fixing device as a fourth variation of the fixing device shown in FIG. 2.

FIG. 16 is a schematic vertical sectional view of a fixing device 20V incorporating a fixing belt 69. As shown in FIG. 16, the fixing device 20V includes the fixing belt 69 stretched taut across a fixing roller 70, a pressure pad 71, a sheet heat generator 72, and a reinforcement 73 supporting the sheet heat generator 72. The sheet heat generator 72 is not disposed opposite a pressure roller 74. Instead, the fixing roller 70 and the pressure pad 71 press against the pressure roller 74 to form a relatively greater fixing nip N having an increased length in a sheet conveyance direction. The greater fixing nip N increases an area in which the fixing belt 69 contacts a sheet conveyed through the fixing nip N. Accordingly, the fixing belt 69 heats the sheet sufficiently even if the fixing belt 69 is installed in the high speed fixing device 20V where the sheet is conveyed at high speed.

The fixing devices 20, 20S, 20T, 20U, and 20V that employ the control methods according to the exemplary embodiments described above are installable in the image forming apparatus 1 depicted in FIG. 1 and other image forming apparatuses such as a copier, a facsimile machine, a printer, a multifunction peripheral or a multifunction printer (MFP) having at least one of copying, printing, scanning, facsimile, and plotter functions, or the like.

A description is provided of advantages of the image forming apparatus 1 incorporating the fixing device 20, 20S, 20T, 20U, or 20V.

The image forming apparatus 1 includes a fixing device (e.g., the fixing devices 20, 20S, 20T, 20U, and 20V) and a controller (e.g., the controller 40) for controlling the fixing device. The fixing device includes a fixing rotator (e.g., the fixing belts 21, 51, 58, 62, and 69) rotatable in a predetermined direction of rotation; a heater (e.g., the heaters 25 and 55, the sheet heat generators 57 and 72, and the induction heater 61) disposed opposite the fixing rotator to heat the fixing rotator; an opposed rotator (e.g., the pressure rollers 22, 52, 59, 66, and 74) to press against the fixing rotator to form the fixing nip N therebetween; and a temperature detector (e.g., the temperature sensor 28) disposed opposite the fixing rotator to detect a temperature of the fixing rotator. As a recording medium (e.g., a sheet P) bearing a toner image (e.g., a toner image T) is conveyed through the fixing nip N, the fixing rotator and the opposed rotator fix the toner image on the recording medium. The controller controls the heater to switch between the primary heating H1 and the secondary heating H2 during an identical print job. In the primary heating H1, the controller supplies a first amount of power determined based on the temperature of the fixing rotator detected by the temperature detector to the heater. In the secondary heating H2, the controller supplies a preset second amount of power to the heater. The controller performs at least one of a primary switching from the primary heating H1 to the secondary heating H2 and a secondary switching from the secondary heating H2 to the primary heating H1 based on a time different from a preset control cycle that defines a power supply time in the primary heating H1 and the secondary heating H2.

Accordingly, the controller switches from the primary heating H1, in which the controller supplies the heater the first amount of power determined based on the temperature of the fixing rotator detected by the temperature detector, to the secondary heating H2, in which the controller supplies the heater the preset second amount of power. Consequently, the controller increases the amount of power supplied to the heater substantially as needed, heating the fixing rotator quickly. Further, at least one of the primary switching from the primary heating H1 to the secondary heating H2 and the secondary switching from the secondary heating H2 to the primary heating H1 is performed at a time different from the preset control cycle, thus switching between the primary heating H1 and the secondary heating H2 at a proper time.

According to the exemplary embodiments described above, the fixing belt 21 serves as a fixing rotator. Alternatively, a fixing roller, a fixing film, a fixing sleeve, or the like may be used as a fixing rotator. Further, the pressure roller 22 serves as an opposed rotator. Alternatively, a pressure belt or the like may be used as an opposed rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. An image forming apparatus comprising:

a fixing rotator rotatable in a predetermined direction of rotation;

a heater disposed opposite the fixing rotator to heat the fixing rotator;

an opposed rotator to press against the fixing rotator to form a fixing nip therebetween through which a recording medium bearing a toner image is conveyed;

a temperature detector disposed opposite the fixing rotator to detect a temperature of the fixing rotator; and a controller operatively connected to the temperature detector and the heater, the controller including:

a primary heating control portion to determine a first amount of power supplied to the heater based on the temperature of the fixing rotator detected by the temperature detector and to control the heater to perform a primary heating to heat the fixing rotator with the first amount of power;

a secondary heating control portion to control the heater to perform a secondary heating to heat the fixing rotator with a preset second amount of power; and a switch portion to control the heater to switch between the primary heating and the secondary heating during an identical print job and to perform at least one of a primary switching from the primary heating to the secondary heating and a secondary switching from the secondary heating to the primary heating at a time different from a preset control cycle that defines a power supply time in the primary heating and the secondary heating.

2. The image forming apparatus according to claim 1, wherein the switch portion of the controller performs the primary switching from the primary heating to the secondary heating and the secondary switching from the secondary heating to the primary heating at a time different from the preset control cycle.

3. The image forming apparatus according to claim 1, wherein the secondary heating control portion of the controller controls the heater to perform the secondary heating at least while the recording medium is conveyed through the fixing nip.

4. The image forming apparatus according to claim 1, wherein the switch portion of the controller performs the primary switching from the primary heating to the secondary heating at a time earlier than entry of a leading edge of the recording medium in a recording medium conveyance direction to the fixing nip by a heat conduction time period taken from start of power supply to the heater until a temperature of a surface of the fixing rotator starts increasing.

5. The image forming apparatus according to claim 4, further comprising a registration sensor, disposed upstream from the fixing nip in the recording medium conveyance direction, to detect the recording medium and output a registration signal upon detection of the recording medium, wherein the switch portion of the controller is operatively connected to the registration sensor to recognize entry of the recording medium to the fixing nip based on the registration signal from the registration sensor.

6. The image forming apparatus according to claim 1, wherein the switch portion of the controller performs the secondary switching from the secondary heating to the primary heating at a time earlier than ejection of a trailing edge of the recording medium in a recording medium conveyance direction from the fixing nip by a heat conduction time period taken from start of power supply to the heater until a temperature of a surface of the fixing rotator starts increasing.

7. The image forming apparatus according to claim 6, further comprising a registration sensor, disposed upstream from the fixing nip in the recording medium conveyance direction, to detect the recording medium and output a registration signal upon detection of the recording medium, wherein the switch portion of the controller is operatively connected to the registration sensor to recognize ejection of the recording medium from the fixing nip based on the registration signal from the registration sensor.

8. The image forming apparatus according to claim 1, wherein the controller further includes a correction portion, operatively connected to the temperature detector and the secondary heating control portion, to change the second amount of power supplied to the heater in the secondary heating per power supply time.

9. The image forming apparatus according to claim 8, wherein the correction portion of the controller corrects the second amount of power supplied to the heater in the secondary heating based on a difference between the temperature of the fixing rotator detected by the temperature detector and a target temperature of the fixing rotator during the identical print job.

10. The image forming apparatus according to claim 1, wherein the switch portion of the controller switches between the primary heating and the secondary heating in the identical print job without changing a target temperature of the fixing rotator.

11. The image forming apparatus according to claim 1, wherein the switch portion of the controller controls the heater to perform the secondary heating independently from the primary heating.

12. The image forming apparatus according to claim 1, wherein the secondary heating control portion of the controller determines the second amount of power supplied to the heater in the secondary heating based on a type of the recording medium.

13. The image forming apparatus according to claim 12, wherein the type of the recording medium is defined by one of a size, a paper weight, and a thickness of the recording medium.

14. The image forming apparatus according to claim 1, wherein the heater includes a halogen heater.

15. The image forming apparatus according to claim 1, further comprising a nip formation pad disposed opposite the opposed rotator and contacting an inner circumferential surface of the fixing rotator, wherein the fixing rotator includes an endless fixing belt rotatable about a single axis.

16. The image forming apparatus according to claim 1, wherein the fixing rotator has a thickness not greater than about 300 micrometers.

17. An image forming method comprising:

starting a primary heating to heat a fixing rotator with a first amount of power determined based on a temperature of the fixing rotator;

starting feeding a recording medium to the fixing rotator; and switching from the primary heating to a secondary heating to heat the fixing rotator with a preset second amount of power at a time different from a preset control cycle that defines a power supply time in the primary heating and the secondary heating.

18. The image forming method according to claim 17, further comprising switching from the secondary heating to the primary heating at the time different from the preset control cycle.

19. The image forming method according to claim 18, wherein switching from the primary heating to the secondary heating is performed when a first time has elapsed after a registration signal is output upon detection of the recording medium, and wherein switching from the secondary heating to the primary heating is performed when a second time has elapsed after the registration signal is output upon detection of the recording medium.

20. The image forming method according to claim 18, wherein switching from the primary heating to the secondary heating is performed at a time earlier than entry of the recording medium to a fixing nip formed between the fixing rotator and an opposed rotator by a heat conduction time period taken for heat to be conducted from a heater to the fixing rotator, and wherein switching from the secondary heating to the primary heating is performed at a time earlier than ejection of the recording medium from the fixing nip by the heat conduction time period.

* * * * *